US009833992B2

(12) United States Patent
Taniguchi et al.

(10) Patent No.: US 9,833,992 B2
(45) Date of Patent: Dec. 5, 2017

(54) RECORDING-ELEMENT SUBSTRATE, RECORDING HEAD, AND RECORDING APPARATUS

(71) Applicant: CANON KABUSHIKI KAISHA, Tokyo (JP)

(72) Inventors: Suguru Taniguchi, Kawasaki (JP); Koichi Omata, Kawasaki (JP); Hideo Tamura, Kawasaki (JP); Takaaki Yamaguchi, Yokohama (JP); Kousuke Kubo, Kawasaki (JP); Ryoji Oohashi, Yokohama (JP); Yuji Tamaru, Yokohama (JP); Toshio Negishi, Yokohama (JP); Yohei Osuki, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/382,079

(22) Filed: Dec. 16, 2016

(65) Prior Publication Data

US 2017/0173953 A1 Jun. 22, 2017

(30) Foreign Application Priority Data

Dec. 21, 2015 (JP) ..... 2015-249126

(51) Int. Cl.
*B41J 2/14* (2006.01)

(52) U.S. Cl.
CPC ..... *B41J 2/14145* (2013.01); *B41J 2/1404* (2013.01); *B41J 2/14072* (2013.01); *B41J 2/14112* (2013.01); *B41J 2/14129* (2013.01)

(58) Field of Classification Search
None
See application file for complete search history.

(56) References Cited

U.S. PATENT DOCUMENTS 7,267,430 B2 9/2007 Parish
2005/0046677 A1* 3/2005 Park ..... B41J 2/14129 347/64

* cited by examiner

*Primary Examiner* — Lisa M Solomon
(74) *Attorney, Agent, or Firm* — Canon USA, Inc., IP Division

(57) ABSTRACT

A recording-element substrate includes a substrate including a base member, a pair of electrodes, a heating element formed of a thermal resistor layer between the electrodes, a surface on which an electroconductive film coating the heating element has been formed, and an insulating film between the heating element and the electroconductive film and a flow-path-forming member including walls forming a liquid flow path toward the heating element while being disposed on the substrate's surface side. The substrate includes an electric connecting portion in contact with the electroconductive film to connect the electroconductive film with the base member. The shortest distance between the electric connecting portion and a portion where an angle formed by the walls is 120 degrees or smaller when viewed from a direction orthogonal to the surface is smaller than that between a boundary between the electrodes and the heating element and the portion.

12 Claims, 6 Drawing Sheets

RECORDING-ELEMENT SUBSTRATE, RECORDING HEAD, AND RECORDING APPARATUS

BACKGROUND OF THE INVENTION

Field of the Invention

The aspect of the embodiments relates to a recording-element substrate that is to be mounted on a liquid discharge head, a recording head, and a recording apparatus.

Description of the Related Art

An example of an information-output apparatus that records information regarding a desired letter, image, or the like onto a recording medium, such as a sheet or a film, is a recording apparatus that performs recording by discharging a liquid. The recording apparatus performs recording by causing liquid droplets discharged from a liquid discharge head to land on a recording medium. There are various methods by which such a liquid discharge head discharges a liquid. A thermal method is a well-known example of a liquid discharging method. The thermal method is a liquid discharging method in which liquid droplets are discharged by using foaming of a liquid such as an ink that is induced by thermal energy generated by passing a current through a heater, which is brought into contact with the liquid, for about a few μs. In general, a liquid discharge head that is used in the thermal method is provided with a recording-element substrate that includes a heater (hereinafter also referred to as heating element), which serves as a recording element.

The recording-element substrate includes a substrate on which the heater has been formed, a flow-path-forming member, and a discharge-port-forming member. An example of the configuration of the heater is one in which a portion of a heater electrode provided on the substrate is removed, and a heater layer positioned between portions of the heater electrode functions as the heater. The heater is coated with a cavitation resistant layer that protects the heater against heat and physical and chemical impacts generated at the time of foaming and defoaming of a liquid. In addition, an insulating layer is disposed between the heater and the heater electrode and the cavitation resistant layer.

An example of a process for manufacturing a liquid discharge head will now be described. First, a heater and the like are formed on a substrate in a wafer state, after which a dry film is attached to the substrate. Then, a flow-path-forming member and a discharge-port-forming member are formed by using a resist coating or the like. Next, the substrate in a wafer state is attached to a dicing tape and cut by using a diamond saw or the like. The recording-element substrate that has been cut into individual substrates is cleaned in order to remove swarf and the like while being attached to the dicing tape. After that, the recording-element substrate is separated from the dicing tape, and each of the individual substrates is incorporated into a liquid discharge head.

Issues may sometimes occur in a recording-element substrate due to electrostatic discharge (hereinafter referred to as ESD) during, for example, the above-described process for manufacturing a recording-element substrate and during a recording operation performed by a liquid discharge head. U.S. Pat. No. 7,267,430 describes a phenomenon in which, in a recording-element substrate that includes an insulating layer having a film thickness of about 200 nm, electrical breakdown occurs in the insulating layer, which is positioned between a cavitation resistant layer and a heater electrode, due to ESD. In addition, U.S. Pat. No. 7,267,430 describes a configuration in which the cavitation resistant layer is connected to a grounded-gate metal oxide semiconductor (MOS) in order to prevent the phenomenon from occurring. Furthermore, U.S. Pat. No. 7,267,430 describes an advantageous effect in which, by employing the above configuration, a current that has been generated by ESD and that has flowed in the cavitation resistant layer can escape to a substrate, and thus, electrical breakdown can be prevented from occurring in the insulating layer positioned between the cavitation resistant layer and the heater electrode.

SUMMARY OF THE INVENTION

A recording-element substrate according to an aspect of the embodiments includes a substrate that includes a base member, a pair of electrodes, a heating element formed of a thermal resistor layer, which is positioned between the pair of electrodes, a surface on which an electroconductive film coating the heating element has been formed, and an insulating film positioned between the heating element and the electroconductive film and a flow-path-forming member that is disposed on a side of the surface of the substrate and that includes walls for forming a flow path through which a liquid flows to the heating element. The substrate includes an electric connecting portion that is in contact with the electroconductive film and that connects the electroconductive film and the base member to each other, and the shortest distance between the electric connecting portion and a portion where an angle formed by the walls is not more than 120 degrees when viewed from a direction orthogonal to the surface is smaller than the shortest distance between a boundary between the pair of electrodes and the heating element and the portion.

Further features of the aspect of the embodiments will become apparent from the following description of exemplary embodiments with reference to the attached drawings.

DESCRIPTION OF THE EMBODIMENTS

Figure 6:
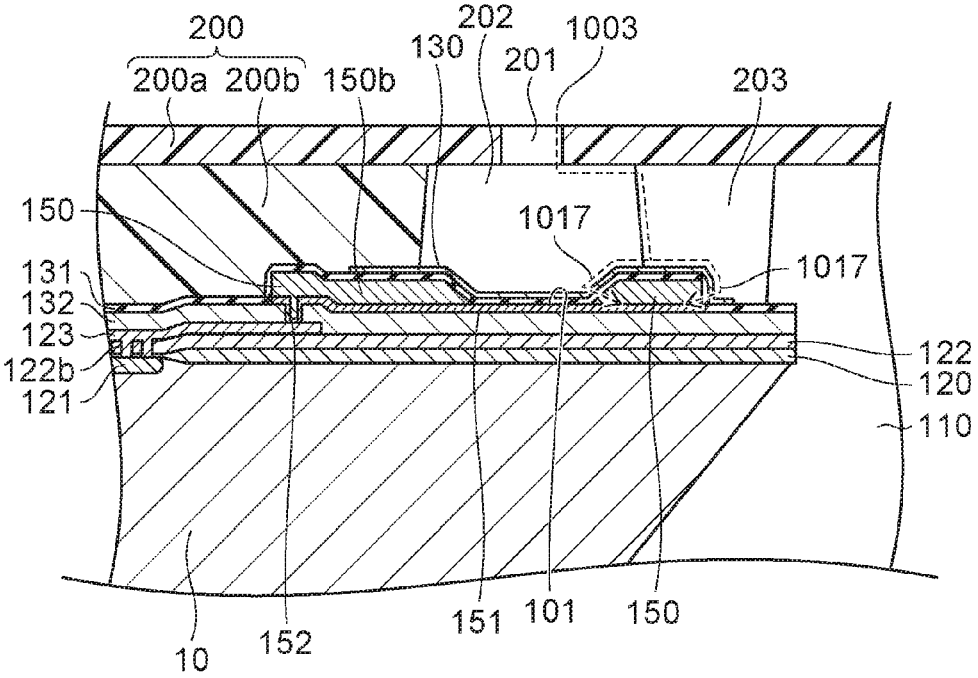
FIG. 6 is a sectional view illustrating a path of an ESD current.
Figure 7:
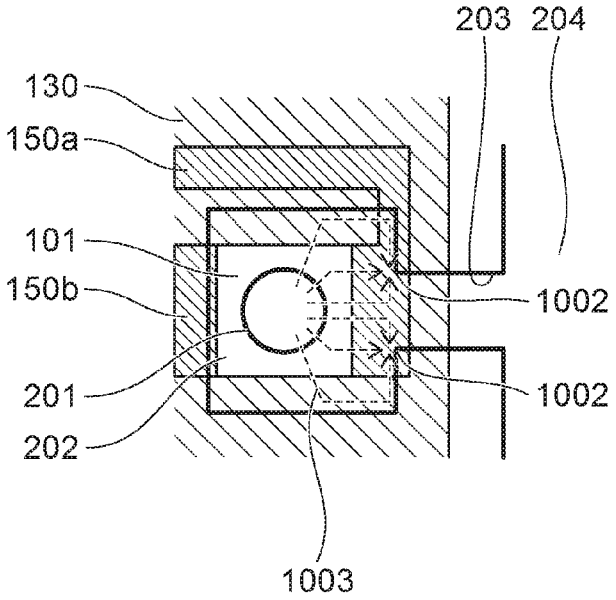
FIG. 7 is a plan view illustrating a path of an ESD current.

An ESD current is likely to concentrate at some locations in a recording-element substrate, and there is a possibility of electrical breakdown occurring in an insulating layer due to the ESD current. This matter will now be described with reference to FIG. 6 and FIG. 7. FIG. 6 is a sectional view of a recording-element substrate illustrating one of heaters 101, a corresponding one of discharge ports 201, and the peripheral portions, and FIG. 7 is an enlarged plan view of the peripheral portion of the heater 101. Note that, some components are illustrated in a see-through manner in FIG. 7 in order to illustrate the position of the heater 101.

One of insulating layers 131 is provided above the heater 101, a corresponding one of heater electrodes 150*a*, and a corresponding one of heater electrodes 150*b*. In addition, one of cavitation resistant layers 130 is provided above the insulating layer 131. An ESD current 1003 that has flowed in the vicinity of the discharge port 201 from the outside flows along a creepage surface of a discharge-port-forming member 200*a* and a creepage surface of a flow-path-forming member 200*b*. In addition, the ESD current 1003 flows in a direction in which the electric potential thereof is more stable, that is, flows toward a region in the discharge-port-forming member 200*a* and a region in the flow-path-forming member 200*b* that the ESD current 1003 has not yet reached in such a manner as to be diffused in all directions. The ESD current 1003, which has been diffused, reaches the cavitation resistant layer 130 that is made of a metal material or the like and that has a conductivity higher than that of the discharge-port-forming member 200*a*, which is made of a resin, and that of the flow-path-forming member 200*b*, which is made of a resin.

The ESD current 1003 is likely to concentrate at some locations through a process in which the ESD current 1003 is diffused depending on the shape of a member 200, which forms a corresponding one of foaming chambers 202 and a corresponding one of flow paths 203. In other words, the ESD current 1003 is likely to concentrate at a corner portion of the flow-path-forming member 200*b*, the corner portion having a small angle when viewed from a direction orthogonal to a surface of a substrate 100 on which the heater 101 has been formed. In FIG. 7, corner portions 1002 of the flow-path-forming member 200*b* that allow the flow path 203 and the foaming chamber 202 to communicate with each other are located close to the discharge port 201, and the corner portions 1002 each have an angle smaller than that of a portion of the flow-path-forming member 200*b* in the vicinity of the corner portions 1002. Consequently, the ESD current 1003 is likely to concentrate at the corner portions 1002 and the cavitation resistant layer 130, which is located in the vicinity of the corner portions 1002. The voltage in the cavitation resistant layer 130 is partially high at a location at which the ESD current 1003 has concentrated, and thus, if a portion where the insulating property of the insulating layer 131 is low, examples of the portion being steps 1017 (FIG. 6) formed of the heater electrodes 150*a* and 150*b*, is present in the vicinity of the location at which the voltage is high, there is a possibility of electrical breakdown occurring.

In particular, in the case of a substrate that is long, if the configuration described in U.S. Pat. No. 7,267,430 is employed, the distance between a grounded-gate MOS and a heater increases, and accordingly, the distance between a cavitation resistant layer provided on the heater and the grounded-gate MOS increases. As a result, the distance between a location in the cavitation resistant layer where a current has flowed in due to ESD and the grounded-gate MOS increases, and electrical breakdown is likely to occur due to ESD at a location that is between the location where the current has flowed in and the grounded-gate MOS and at which the insulating property of an insulating film is low.

Accordingly, the aspect of the embodiments is directed at reducing the probability of electrical breakdown occurring in an insulating film due to an ESD current.

Embodiment

Figure 4:
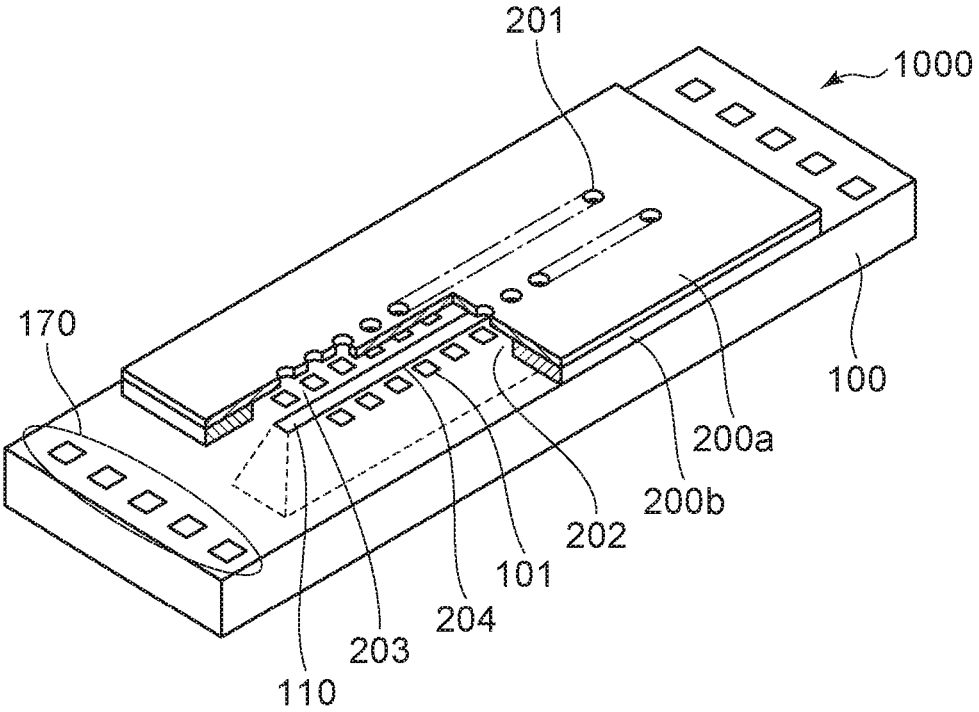
FIG. 4 is a perspective view of the recording-element substrate.
Figure 8:
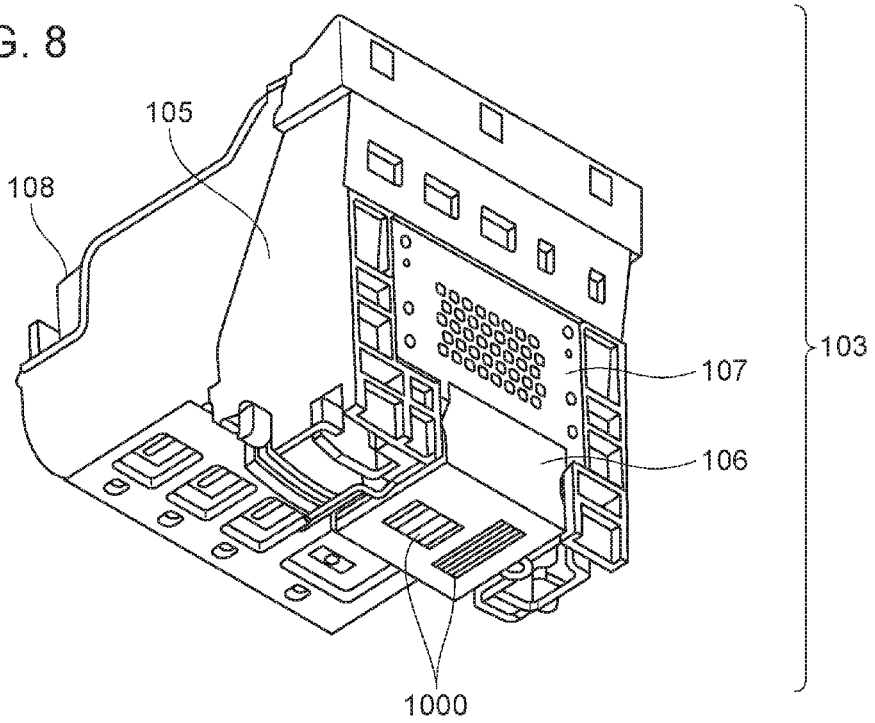
FIG. 8 is a perspective view of a recording head.
Figure 9:
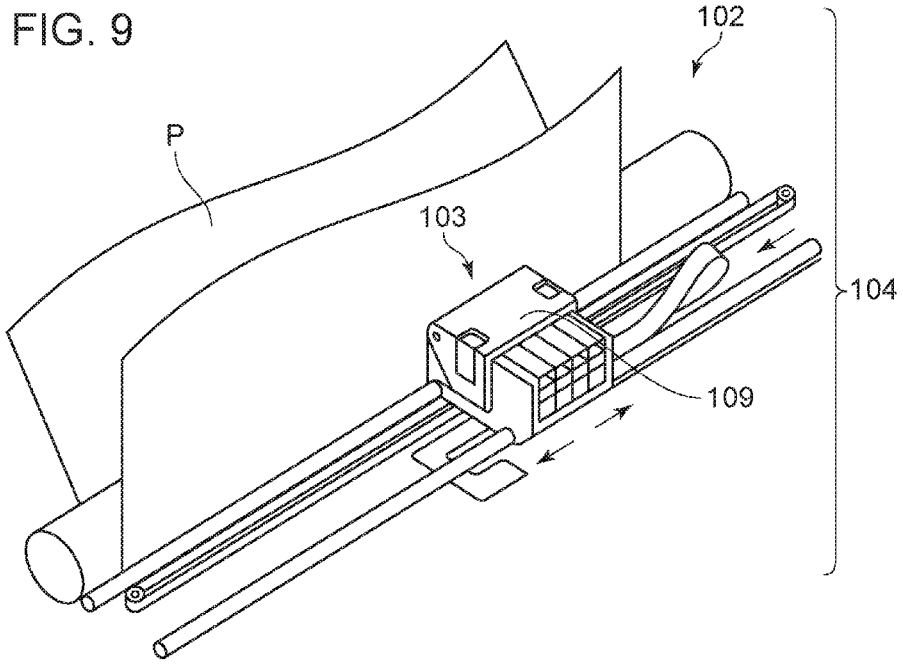
FIG. 9 is a perspective view of a recording apparatus.

FIG. 4 is a perspective view illustrating an example of a recording-element substrate 1000 to which the aspect of the embodiments can be applied. FIG. 8 is a perspective view illustrating an example of a recording head 103 on which the recording-element substrate 1000 has been mounted, and FIG. 9 is a perspective view illustrating an example of a recording apparatus 104 on which the recording head 103 has been mounted.

The recording head 103 on which the recording-element substrate 1000 is mounted includes a housing 105 for mounting a liquid container 108 in which a liquid to be discharged from the recording-element substrate 1000 is contained. The recording head 103 further includes an electrical wiring board 107, which includes a terminal for being electrically connected to the outside, and an electrical wiring member 106 that connects the electrical wiring board 107 and the recording-element substrate 1000 to each other.

The recording apparatus 104 includes a conveying unit 102 that conveys a recording medium P and a carriage 109 that causes the recording head 103 to scan while holding the recording head 103 therein. The recording head 103 performs recording by discharging liquid droplets while being scanned and by causing the liquid droplets to land on desired locations on the recording medium P. After the recording head 103 has completed a scanning operation, the recording medium P is conveyed by the conveying unit 102 in a direction perpendicular to a scanning direction in which the recording head 103 performs the scanning operation. By repeating these operations, recording performed on the recording medium P is completed.

As illustrated in FIG. 4, the recording-element substrate 1000 includes a substrate 100 on which a plurality of heaters 101 (heating elements) serving as recording elements are disposed, a discharge-port-forming member 200*a*, and a flow-path-forming member 200*b*. The substrate 100 includes a supply port 110 used for supplying the liquid, which is to be discharged from the recording-element substrate 1000. The flow-path-forming member 200*b* forms a plurality of foaming chambers 202 in each of which a corresponding one of the heaters 101 is disposed, flow paths 203 (flow-path portions) each of which is connected to a corresponding one of the foaming chambers 202, and a liquid chamber 204 that allows the flow paths 203 and the supply port 110 to communicate with each other. The discharge-port-forming member 200*a* forms a plurality of discharge ports 201 each of which corresponds to one of the heaters 101. Note that a configuration in which the discharge-port-forming member 200*a* and the flow-path-forming member 200*b* are integrally formed may be employed. The plurality of heaters 101 are arranged so as to form heater arrays, and the plurality of discharge ports 201 and the plurality of foaming chambers 202 are each arranged so as to correspond to one of the heaters 101. The substrate 100 includes a plurality of terminals 170 used for supplying a voltage and a signal from the outside to the substrate 100.

Figure 1:
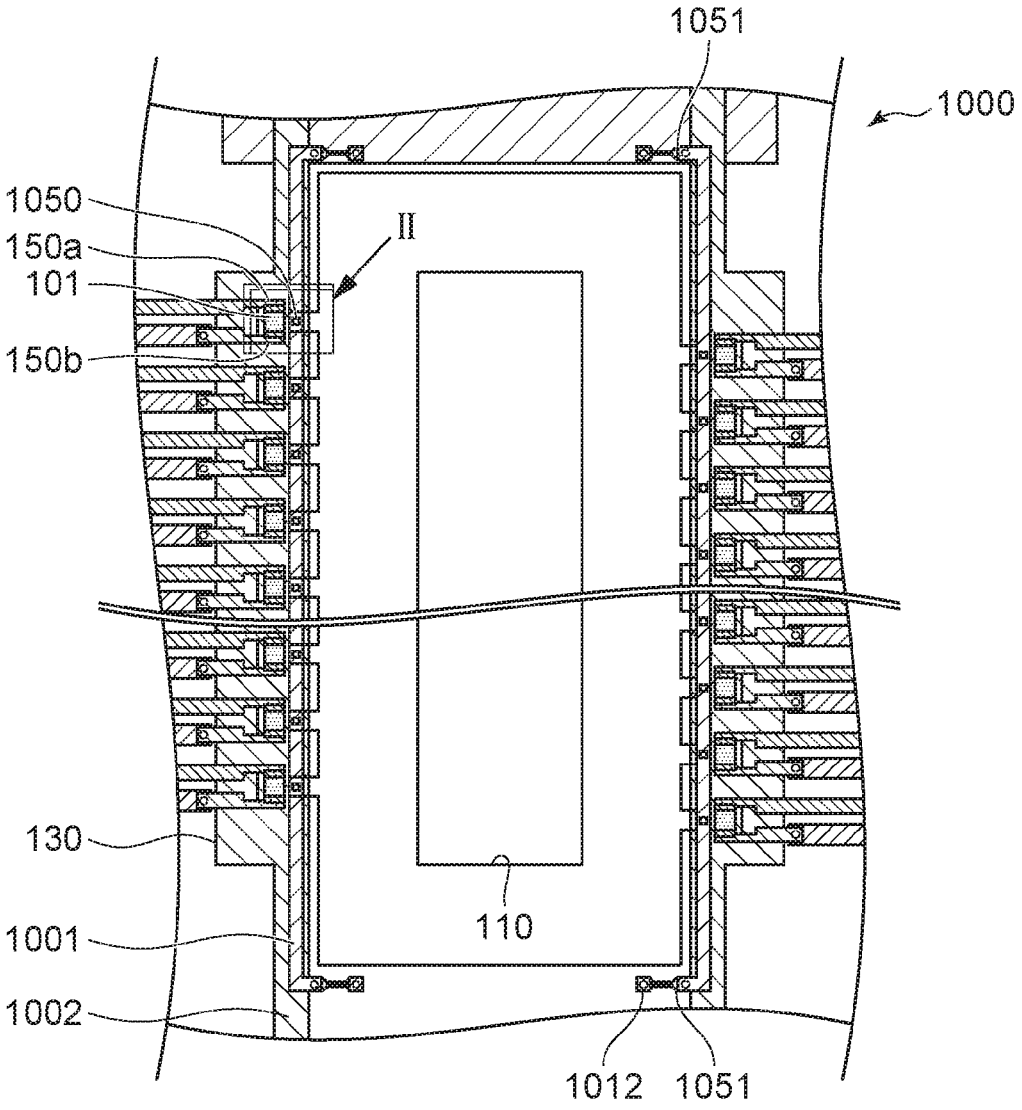
FIG. 1 is a plan view illustrating a portion of a recording-element substrate according to an embodiment of the disclosure.
Figure 2:
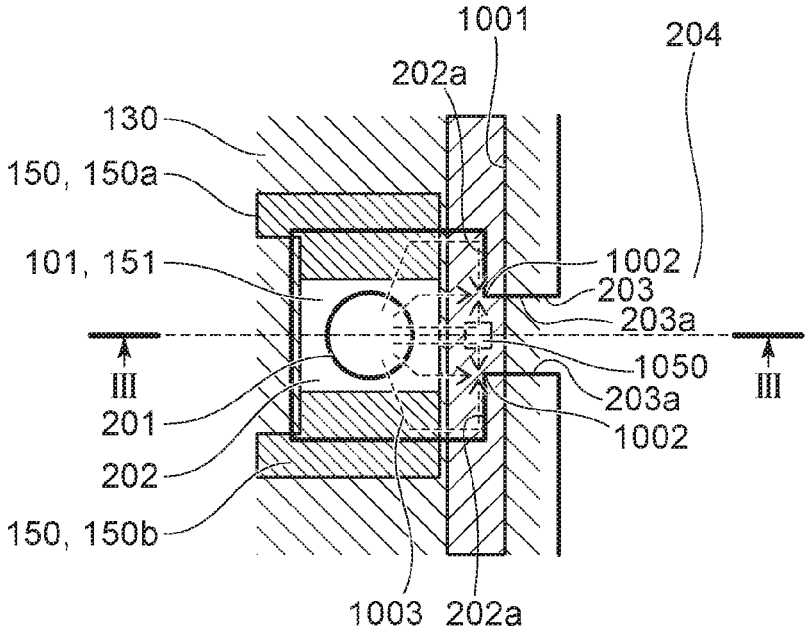
FIG. 2 is an enlarged view of the peripheral portion of a heater illustrated in FIG. 1.

FIG. 1 is a plan view illustrating the heater arrays and the supply port 110 of the recording-element substrate 1000 according to an embodiment to which the disclosure can be applied and illustrating the peripheral portions of the heater arrays and the supply port 110. FIG. 2 is an enlarged view of the peripheral portion (portion indicated by frame II in FIG. 1) of one of the heaters 101. Note that, in FIG. 1 and FIG. 2, some components are illustrated in a see-through manner in order to describe the layouts of the heaters 101, ESD inductive wiring lines 1001 (described later), ESD inductive connecting portions 1050 (described later), and the like. Similarly, some components are illustrated in a see-through manner in the other plan views, which will be described later.

Figure 3:
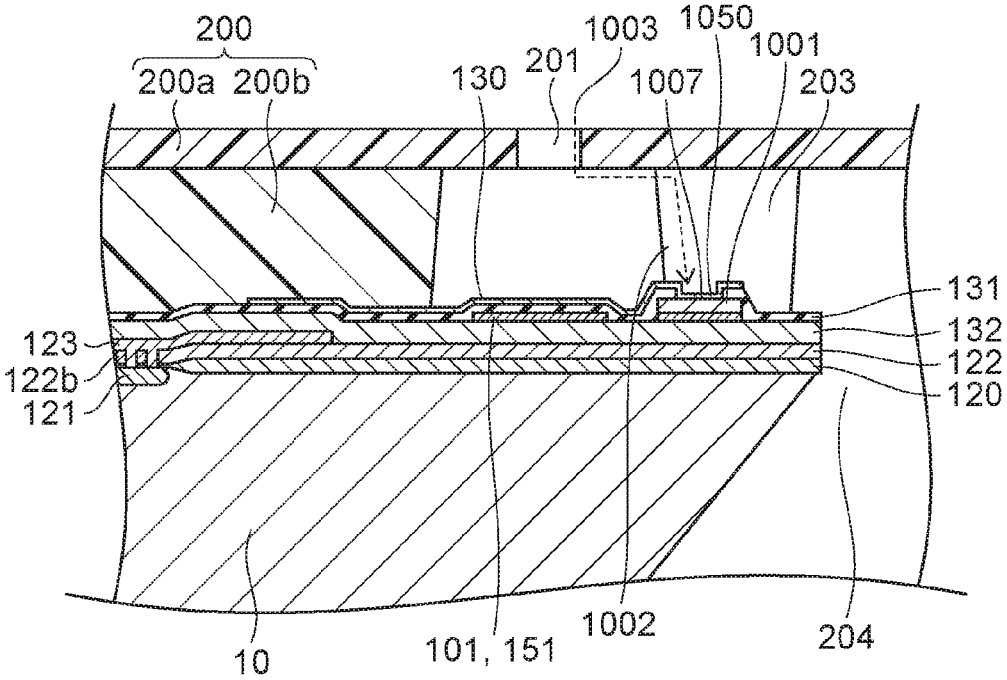
FIG. 3 is a sectional view taken along line III-III of FIG. 2.

Since the plurality of heaters 101 have the same configuration, the configuration of the peripheral portion of one of the heaters 101 illustrated in FIG. 3 will be described below as a representative example. FIG. 3 is a sectional view taken along line III-III of FIG. 2. A thermal oxide film 120 and a gate oxide film 121 are formed on a silicon base member 10. A first heat-storage layer 122 is formed on the thermal oxide film 120. A first switching-element electrode 123 is formed on the first heat-storage layer 122. The first switching-element electrode 123 is connected to the base member 10 by a via 122*b* formed in the first heat-storage layer 122. An impurity-diffusion region is formed in a connection region in which the first switching-element electrode 123 and the base member 10 are connected to each other.

A second heat-storage layer 132 is formed on the first switching-element electrode 123. A heater layer 151 serving as a thermal resistor layer is formed on the second heat-storage layer 132. A heater-electrode layer 150 (FIG. 2) is formed on the heater layer 151, and a common heater electrode 150*a* and an individual heater electrode 150*b* serving as a pair of electrodes are formed by the heater-electrode layer 150. The heater 101 is formed of the heater layer 151, which is formed between the common heater electrode 150*a* and the individual heater electrode 150*b*. The heater 101 is connected to the first switching-element electrode 123 by a via formed in the second heat-storage layer 132.

An insulating layer 131 made of SiC, SiN, SiCN, or the like is formed on the common heater electrode 150*a* and the individual heater electrode 150*b*. A cavitation resistant layer 130 made of a material such as Ta or Ir is formed on the insulating layer 131. The heater 101 is coated with the cavitation resistant layer 130 functioning as an electroconductive film. The cavitation resistant layer 130 is a protective layer that protects the heater 101 against heat and physical and chemical impacts generated at the time of foaming and defoaming of a liquid.

The flow-path-forming member 200*b* is formed on the cavitation resistant layer 130 and the insulating layer 131, and the discharge-port-forming member 200*a* is formed on the flow-path-forming member 200*b*.

A configuration for enabling an ESD current 1003 to escape to the base member 10 will now be described. The ESD current 1003 that has flowed in the vicinity of the discharge port 201 from the outside flows into the vicinity of the heater 101 by passing through a wall forming the discharge port 201 and a wall forming the foaming chamber 202 in this order. The ESD current 1003, which has flowed in, is likely to concentrate at corner portions 1002 (FIG. 2) of the flow-path-forming member 200*b* and the cavitation resistant layer 130 located in the vicinity of the corner portions 1002. This is because, in the flow-path-forming member 200*b*, the corner portions 1002 are located in the vicinity of the discharge port 201 and connect the foaming chamber 202 and the flow path 203 to each other, and each of the corner portions 1002 forming part of the foaming chamber 202 and part of the flow path 203 has an angle smaller than that of the peripheral portion of the corner portion 1002.

The voltage in the cavitation resistant layer 130 is partially high at a location at which the ESD current 1003 has concentrated. Thus, if a portion having a low insulating property due to a low film thickness or a low film quality of the insulating layer 131, examples of the portion being steps 1017 formed of the heater electrodes 150*a* and 150*b*, is present in the vicinity of the location at which the voltage is high, there is a possibility of electrical breakdown occurring at the portion.

Accordingly, in the present embodiment, the ESD inductive connecting portion 1050 that induces the ESD current 1003 is disposed in the vicinity of the corner portions 1002 on the side on which the substrate 100 is present. More specifically, the ESD inductive connecting portion 1050 is disposed in such a manner that a shortest distance D1 between the ESD inductive connecting portion 1050 and one of the corner portions 1002 is smaller than a shortest distance D2 between the boundary between the heater electrode 150 and the heater 101 and the corner portion 1002.

Note that the term "corner portion" refers to a portion where the angle formed by walls forming a flow path is 120 degrees or smaller when viewed from a direction orthogonal to a surface of the substrate 100 on which the cavitation resistant layer 130 has been formed, and the shape of the corner portion includes a slightly contoured shape. In particular, the above-mentioned concentration of the ESD current 1003 is more likely to occur at the corner portion where the angle is 90 degrees or smaller.

The shortest distance D1 is the shortest distance between the ESD inductive connecting portion 1050 and one of the corner portions 1002 that is closest to the ESD inductive connecting portion 1050. The shortest distance D2 is the shortest distance between the corner portion 1002 and the boundary between the heater 101, which is closest to the corner portion 1002, and the heater electrode 150 (150*a* or 150*b*). Here, the boundary between the heater electrode 150 and the heater 101 is a ridge line where the heater electrode 150 positioned on the two sides of the heater 101 and the heater 101 are in contact with each other and is a portion where the film thickness of the insulating layer 131 is small or the film quality of the insulating layer 131 is low as described above.

As illustrated in FIG. 2, in the present embodiment, each of the corner portions 1002 is formed of a wall 202*a* that forms the foaming chambers 202 and a wall 203*a* that forms the flow paths 203. Note that a combination of the foaming chambers 202 and the flow paths 203 will also be referred to herein as a flow path.

As illustrated in FIG. 1 to FIG. 3, the ESD inductive connecting portion 1050 is an electric connecting portion that is in contact with the cavitation resistant layer 130, and the cavitation resistant layer 130 is electrically connected to the base member 10 via the ESD inductive connecting portion 1050. More specifically, the ESD inductive connecting portion 1050 connects the cavitation resistant layer 130 and the ESD inductive wiring line 1001 by a via 1007 (FIG. 3), which is formed by removing the insulating layer 131. The ESD inductive connecting portions 1050 are each disposed at a position described above and are each connected to the corresponding ESD inductive wiring line 1001 extending in a direction in which the arrays of the heaters 101 extend (FIG. 1). End portions of the ESD inductive wiring lines 1001 in the direction in which the arrays of the heaters 101 extend are electrically connected to the base member 10 by vias 1012. Since the ability of the base member 10 to store electric charge is sufficiently large compared with those of the cavitation resistant layer 130 and the ESD inductive wiring lines 1001, the base member 10 is likely to draw in the ESD current 1003.

As described above, in the present embodiment, each of the cavitation resistant layers 130 and the base member 10 are electrically connected to each other, and the ESD inductive connecting portions 1050, which are in contact with the corresponding cavitation resistant layers 130 and which are used for the electric connection, are disposed in the vicinity of the corresponding corner portions 1002. More specifically, each of the ESD inductive connecting portions 1050 are disposed in such a manner that the shortest distance D1 between the ESD inductive connecting portion 1050 and the corresponding corner portion 1002 is smaller than the shortest distance D2 between the boundary between the corresponding heater electrode 150 and the corresponding heater 101 and the corner portion 1002. As a result, even in the case where the ESD current 1003 flows into the foaming chambers 202 and then flows into the cavitation resistant layers 130, which are disposed below the corner portions 1002 at which the ESD current 1003 is likely to concentrate, the ESD current 1003 is likely to flow into the base member 10 via the ESD inductive connecting portions 1050. Therefore, the probability that the insulating layers 131, which are positioned in the vicinity of the corresponding heaters 101, will be broken by the ESD current 1003 can be reduced.

Regarding each of the locations where the ESD current 1003 is likely to concentrate, the distance between the location and the corresponding heater electrodes 150*a* and 150*b* may be relatively larger than the distance between the location and the corresponding ESD inductive connecting portion 1050. Accordingly, a direction in which the flow paths 203 extend, that is, a direction in which the liquid flows from the liquid chamber 204 toward the heaters 101 may cross a direction in which each of the common heater electrodes 150*a* and the corresponding individual heater electrode 150*b* face each other. In the present embodiment, the flow paths 203 and the heater electrodes 150*a* and 150*b* are arranged in such a manner that these directions cross at right angles to each other.

In addition, the ESD inductive connecting portions 1050 may at least be disposed at the above-mentioned locations. For example, a configuration may be employed in which the insulating layers 131 are not provided on the ESD inductive wiring lines 1001 and in which the ESD inductive wiring lines 1001 and each of the cavitation resistant layers 130 are in contact with each other along the ESD inductive wiring lines 1001.

In the present embodiment, although ends of fuses 1051 are each directly connected to the base member 10 at an end of a corresponding one of the arrays of the heaters 101, the fuses 1051 and the base member 10 may be connected to each other via a ground layer of a logic circuit or a ground layer of the corresponding heater 101.

As illustrated in FIG. 1, the ESD inductive wiring lines 1001 are electrically connected to the base member 10 at the ends of the arrays of the heaters 101 via the fuses 1051 that may be blown by heat generated as a result of a current flowing therethrough. Electric charge supplied by the ESD current 1003 is used by energy that causes blowout of the fuses 1051, and thus, only a small quantity of electric charge will be stored in the base member 10. As a result, the probability that electric charge stored in the base member 10 will be discharged to a manufacturing apparatus when manufacturing the recording-element substrate 1000, which in turn results in ESD breakdown can be reduced. Therefore, the fuses 1051 may be provided as described above.

In the case where the recording apparatus is used for long periods of time and where the heaters 101 are repeatedly driven, there is a possibility that breakage of a wire will occur in one of the heaters 101 due to cavitation or the like. In this case, the individual heater electrode 150*b* connected to the heater 101 and the corresponding cavitation resistant layer 130 disposed on the heater 101 may sometimes be electrically connected to each other. If a recording operation is continued in this state, a positive electric potential is applied to the individual heater electrode 150*b*, and there is a possibility that the current will flow into the base member 10 via the cavitation resistant layer 130, the corresponding ESD inductive connecting portion 1050, the corresponding ESD inductive wiring lines 1001, and the corresponding fuse 1051. Consequently, the fuses 1051 may be blown in accordance with the potential differences between the two ends of the heaters 101 when the heaters 101 are driven. As a result, even if breakage of a wire occurs in one of the heaters 101, which in turn results in the above-described state, when the heaters 101 are driven afterward, the fuses 1051 are blown by a voltage applied to the heaters 101 and are isolated, and accordingly, the flow of current toward the two ends of the fuses 1051 can be blocked.

Note that the material of the fuses 1051 may be a conductive material such as polysilicon. Alternatively, the fuses 1051 may be made of a material the same as that of the heater layer 151 or the same as that of the ESD inductive wiring lines 1001 and may be formed so as to be partially thin by using. In this case, a common material may be used to form these members, and accordingly, the manufacturing process may be simplified.

The ESD inductive connecting portions 1050 may be disposed at positions that are superposed with the corresponding corner portions 1002, where the ESD current 1003 is likely to concentrate, when the base member 10 is viewed from the direction orthogonal to the surface on which the cavitation resistant layer 130 has been formed. This configuration enables the ESD current 1003 to be more likely to flow toward the base member 10.

The shape of the above-described substrate 100 may be a parallelogram shape, a triangular shape, or other polygonal shapes, and a heat-storage layer formed on the substrate 100 may be processed so as to be flat. In addition, a plurality of the supply ports 110, which are open to the substrate 100, may be formed for each of the arrays of the heaters 101.

Note that there is a case where the influence of the above-mentioned ESD current notably occurs depending on the thickness of a heater electrode and the material of an insulating film. In other words, in the case where the length of a recording-element substrate is increased in order to further improve a recording speed, and where the film thickness of the heater electrode is increased in order to suppress an increase in the resistance of the heater electrode due to the increase in the length of the recording-element substrate, there is a possibility that the insulating property of the insulating film will deteriorate. This is because, for example, in the case where the insulating film is formed by a chemical vapor deposition (CVD) method, a gas, sneaking of a precursor radical, and deposition are likely to deteriorate in the vicinity of a step of the electrode. As a result, the film thickness of the insulating film on a side surface of the heater electrode is likely to be small, and the film quality of the insulating film is likely to deteriorate.

In addition, if a liquid containing various pigment-dispersing elements and solvents is used in order to improve image quality and reliability, there is a possibility that the insulating film will dissolve, and studies have been conducted on the use of SiCN instead of SiC or SiN in order to obtain both chemical stability and electrical insulating property. However, since SiCN is a ternary insulating film, it is difficult to control the film quality thereof compared with the case of a binary insulating film, and there is a possibility that the film quality of the insulating film will deteriorate in the vicinity of the step of the heater electrode.

The present embodiment is also useful in a recording-element substrate in which the influence of an ESD current is likely to occur as a result of using an insulating layer whose film quality has deteriorated as described above.

Other Embodiments

Other embodiments to which the disclosure can be applied will now be described with reference to FIGS. 5A to 5D. In each of the other embodiments, the shape of the flow-path-forming member 200*b* is different from that in the above-described embodiment. Note that the driving configuration of the heaters 101 and the configuration of the ESD inductive connecting portions 1050 in the other embodiments are similar to those in the above-described embodiment.

Figure 5A:
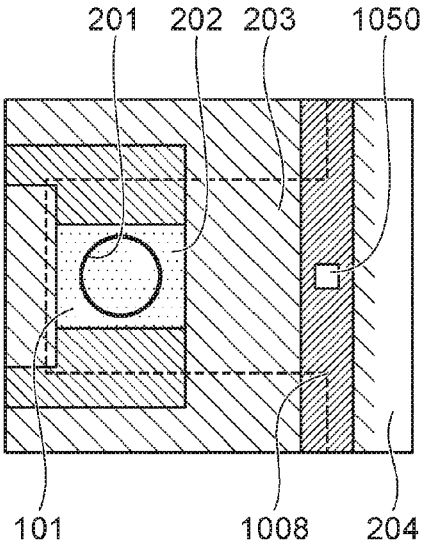
FIGS. 5A to 5D are plan views each illustrating another embodiment.

In FIG. 5A, the cross-sectional area of one of the foaming chambers 202 and the cross-sectional area of the corresponding flow path 203 with respect to the flow direction of the liquid are the same as each other, and an ESD current is likely to concentrate at corner portions 1008, which are formed of the flow-path-forming member 200*b*. Accordingly, the ESD inductive connecting portion 1050 is disposed in the vicinity of the corner portions 1008.

Figure 5B:
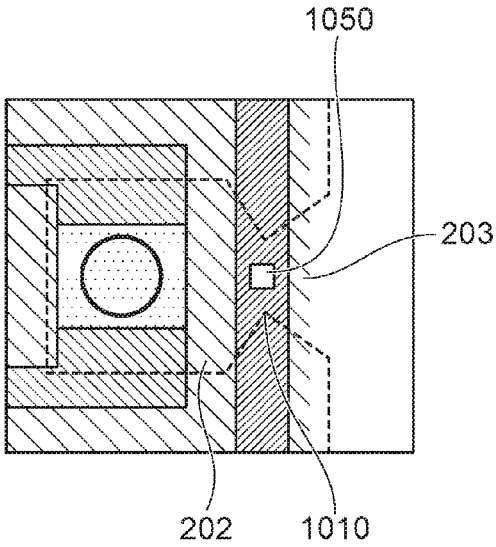

In FIG. 5B, the flow path 203 has a shape in which the cross-sectional area of the flow path 203 with respect to the flow direction of the liquid gradually changes, and the ESD current is likely to concentrate at corner portions 1010, which are formed of the flow-path-forming member 200*b*. Accordingly, the ESD inductive connecting portion 1050 is disposed in the vicinity of the corner portions 1010.

Figure 5C:
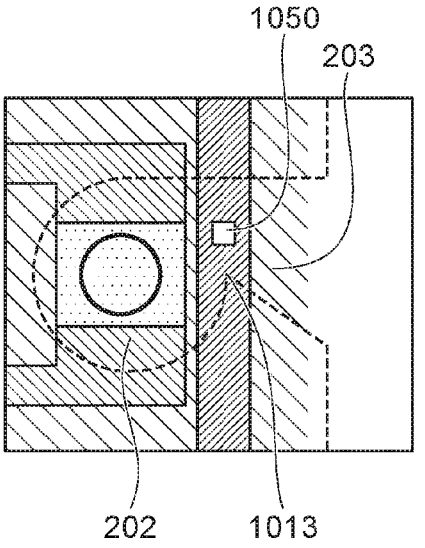

In FIG. 5C, the foaming chamber 202 has a cylindrical shape, and the cross-sectional area of the flow path 203 decreases in a direction toward the foaming chamber 202. In this case, the ESD current is likely to concentrate at a corner portion 1012 that allows the foaming chamber 202 and the flow path 203 to communicate with each other. Accordingly, the ESD inductive connecting portion 1050 is disposed in the vicinity of the corner portion 1013.

Figure 5D:
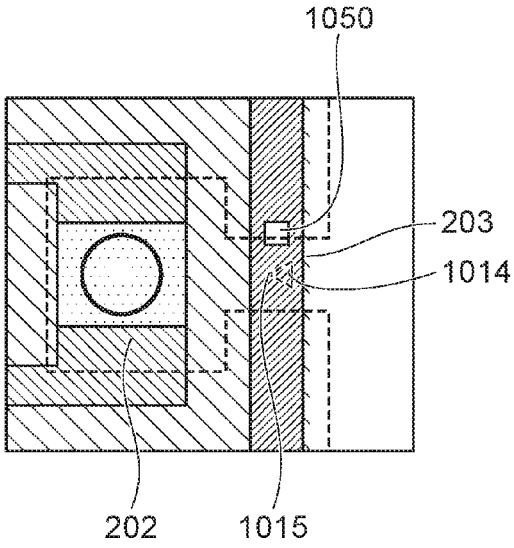

FIG. 5D illustrates a configuration in which a filter 1014 is provided in the flow path 203. A corner portion 1015 that is a portion of the filter 1014 and that is located on the side on which the foaming chamber 202 is present is a portion having the sharpest angle in the vicinity of a heater, and thus, the ESD current is likely to concentrate at the corner portion 1015. Accordingly, the ESD inductive connecting portion 1050 is disposed in the vicinity of the corner portion 1015.

Also in these embodiments, the ESD current 1003 flowed in from the discharge ports 201 can escape to the base member 10 via ESD inductive wiring lines, and thus, the probability of electrical breakdown occurring in the recording-element substrate 1000 can be reduced.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-249126, filed Dec. 21, 2015, which is hereby incorporated by reference herein in its entirety.

What is claimed is:

1. A recording-element substrate comprising:

a substrate that includes a base member, a pair of electrodes, a heating element formed of a thermal resistor layer, which is positioned between the pair of electrodes, a surface on which an electroconductive film coating the heating element has been formed, and an insulating film positioned between the heating element and the electroconductive film; and a flow-path-forming member that is disposed on a side of the surface of the substrate and that includes walls for forming a flow path through which a liquid flows to the heating element, wherein the substrate includes an electric connecting portion that is in contact with the electroconductive film and that connects the electroconductive film and the base member to each other, and wherein the shortest distance between the electric connecting portion and a portion where an angle formed by the walls is not more than 120 degrees when viewed from a direction orthogonal to the surface is smaller than the shortest distance between a boundary between the pair of electrodes and the heating element and the portion.

2. The recording-element substrate according to claim 1, wherein the electric connecting portion and the portion are superposed with each other when viewed from the direction orthogonal to the surface.

3. The recording-element substrate according to claim 1, wherein a direction in which the pair of electrodes face each other and a direction in which the flow path extends cross each other.

4. The recording-element substrate according to claim 1, wherein the electroconductive film is connected to the base member via a wiring line, which is connected to the electric connecting portion, and a fuse, which is connected to the wiring line.

5. The recording-element substrate according to claim 4, further comprising a heating element array formed of a plurality of the heating elements, wherein the wiring line is disposed along the heating element array, and wherein the fuse is disposed at an end of the heating element array.

6. The recording-element substrate according to claim 4, wherein the fuse and the wiring line are made of a common material.

7. The recording-element substrate according to claim 4, wherein the fuse and the thermal resistor layer are made of a common material.

8. The recording-element substrate according to claim 1, wherein the flow path includes a foaming chamber, in which the liquid is made to foam by the heating element, and a flow-path portion that allows the foaming chamber and a supply port formed in the substrate to communicate with each other, and wherein the portion is formed of a wall for forming the foaming chamber and a wall for forming the flow-path portion.

9. The recording-element substrate according to claim 1, wherein the portion is a portion of a filter provided in the flow path.

10. The recording-element substrate according to claim 1, wherein the angle is not more than 90 degrees.

11. A recording head comprising:

the recording-element substrate according to claim 1.

12. A recording apparatus comprising:

the recording head according to claim 11.

* * * * *